US010836189B2

(12) United States Patent
Tanchak et al.

(10) Patent No.: US 10,836,189 B2
(45) Date of Patent: Nov. 17, 2020

(54) CLEANING WEB DISPOSED AND OPERABLE BETWEEN MARKER TRANSPORT BELT AND MARKER PLATEN

(71) Applicant: XEROX CORPORATION, Norwalk, CT (US)

(72) Inventors: Rachel Lynn Tanchak, Rochester, NY (US); Paul M Fromm, Rochester, NY (US); Frank B Tamarez Gomez, Webster, NY (US); Linn Hoover, Webster, NY (US); Jeffrey J Bradway, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/288,157

(22) Filed: Feb. 28, 2019

(65) Prior Publication Data

US 2020/0276847 A1 Sep. 3, 2020

(51) Int. Cl.
*B41J 29/17* (2006.01)
*B41J 11/00* (2006.01)

(52) U.S. Cl.
CPC ..... *B41J 29/17* (2013.01); *B41J 11/007* (2013.01)

(58) Field of Classification Search
CPC ..... B41J 29/17; B41J 11/007
See application file for complete search history.

(56) References Cited

U.S. PATENT DOCUMENTS

| | | | | |
|---|---|---|---|---|
| 5,526,028 | A * | 6/1996 | Rottman | B41J 11/007 347/102 |
| 6,679,601 | B1 * | 1/2004 | Pham | B41J 11/007 134/6 |
| 10,052,896 | B2 * | 8/2018 | Yamaguchi | B41J 11/007 |
| 2019/0270320 | A1 * | 9/2019 | De Roeck | B41J 11/0085 |

* cited by examiner

*Primary Examiner* — Jason S Uhlenhake
(74) *Attorney, Agent, or Firm* — Ortiz & Lopez, PLLC; Kermit D. Lopez; Luis M. Ortiz

(57) ABSTRACT

A movable cleaning web can be positioned and allowed to move from a supply spool, between a platen (e.g., vacuum, marking) and the inside of a belt (e.g., marking, transport), into a take-up spool. The cleaning web can move opposite the process direction of the belt. The web can reduce contamination on the platen, inside of belt and along belt rollers.

20 Claims, 10 Drawing Sheets

CLEANING WEB DISPOSED AND OPERABLE BETWEEN MARKER TRANSPORT BELT AND MARKER PLATEN

TECHNICAL FIELD

Embodiments are generally related to the field of rendering devices, such as printers and photocopiers. Embodiments are further related to the field of rendering device maintenance. Embodiments are also related to methods, systems, and devices for cleaning components in rendering devices. Embodiments also relate to platens and transport belts utilized in printing systems. Embodiments are additionally related to cleaning devices used to clean transport belts, platens and other transport members.

BACKGROUND

Printing remains a critically important function in the modern workplace and home alike. Printers, and in particular ink jet printers, are commonly used for business applications and for simple home printing applications. Printing systems known in the document reproduction arts can apply a marking material, such as ink or toner, onto a substrate such as a sheet of paper, a textile, metal, plastic and objects having a non-negligible depth such as a coffee cup, bottle, and the like.

In large ink jet printers that employ vacuum belt transports, the transport belt can become contaminated with ink and debris. Such fouling can lead to system faults such as motion quality errors and paper handling issues. Currently, the transport belt must be periodically removed from the printer and cleaned, to avoid such errors. This leads to system downtime and increases the risk of damage to components. As the size of the transport components increase, these problems quickly become unmanageable.

A printing system can perform printing of an image or the like on sheets of paper, for example, by transporting a sheet of paper (or other substrates), which is an example of a medium, up to a position of a printing section using a transport roller, and an endless form transport belt (also referred to as a "marker belt"), which can rotate while coming into contact with the sheet of paper, and discharging ink, which is an example of a liquid, toward the sheet of paper from a liquid discharging head. When ink, which is discharged from the liquid discharging head, becomes attached to the outer surface of the transport belt, there is a concern that the ink will be transferred to sheets of paper that are transported by the transport belt, and that the sheets of paper will be stained.

Photoreceptor belts, used in certain printing applications, can also become contaminated with ink. Ink contamination can lead to loss of belt tracking, velocity errors, and paper jams. Once again, the current solution is to remove the belt from the rendering device, clean it, and then reinstall it in the machine. This becomes particularly vexatious as rendering devices are scaled to accommodate larger paper sizes. Larger marker transports make the feasibility of belt removal for cleaning less practical.

Accordingly, very wide and long marker vacuum transport belts become difficult to handle and clean. Accordingly, there is a need in the art for methods and systems that facilitate in-situ cleaning solutions as described in the embodiments disclosed herein. What are needed are systems and methods to clean the transport belt while it is installed in a rendering device.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the disclosed embodiments to provide a method, system, and apparatus for rendering device maintenance.

It is another aspect of the disclosed embodiments to provide a method, system, and apparatus for printer maintenance and cleaning.

It is another aspect of the disclosed embodiments to provide a method, system, and apparatus for cleaning transport belts.

It is another aspect of the disclosed embodiments to provide in-situ cleaning of transport belts.

It is another aspect of the disclosed embodiments to provide a method, system, and apparatus for cleaning transport belts and platens.

It is another aspect of the disclosed embodiments to provide in-situ cleaning of transport belts and platens.

The aforementioned aspects and other objectives and advantages can now be achieved as described herein. A system for the in-situ cleaning of transport belts can include a cleaning web disposed between a marker platen (or vacuum plenum) and a transport belt. The cleaning web can be configured to move opposite in direction to the transport belt over the marker platen. The cleaning web operation can be mechanically adjusted.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

FIGS. 10A-10B, wherein FIG. 10B is a continuation of steps from FIG. 10A, depict a flowchart of steps associated with a method for cleaning a rendering device, in accordance with the disclosed embodiments.

DETAILED DESCRIPTION

Figure 1:
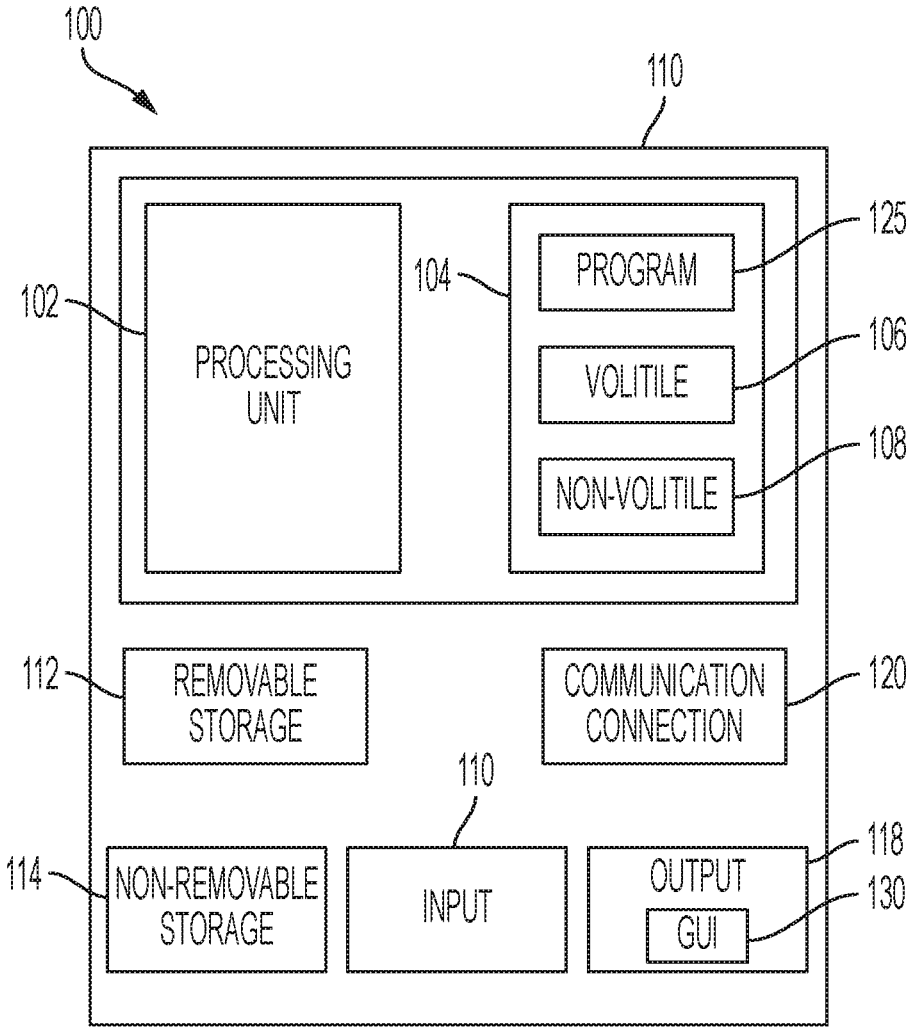
FIG. 1 depicts a block diagram of a computer system which is implemented in accordance with the disclosed embodiments.

The particular values and configurations discussed in these non-limiting examples can be varied and are cited merely to illustrate one or more embodiments and are not intended to limit the scope thereof.

Subject matter will now be described more fully herein after with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems/devices. Accordingly, embodiments may, for example, take the form of hardware, software, firmware or any combination thereof (other than software per se). The following detailed description is, therefore, not intended to be interpreted in a limiting sense.

Throughout the specification and claims, terms may have nuanced meanings suggested or implied in context beyond an explicitly stated meaning. Likewise, phrases such as "in one embodiment" or "in an example embodiment" and variations thereof as utilized herein do not necessarily refer to the same embodiment and the phrase "in another embodiment" or "in another example embodiment" and variations thereof as utilized herein may or may not necessarily refer to a different embodiment. It is intended, for example, that claimed subject matter include combinations of example embodiments in whole or in part.

In general, terminology may be understood, at least in part, from usage in context. For example, terms, such as "and", "or", or "and/or" as used herein may include a variety of meanings that may depend, at least in part, upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a", "an", or "the", again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context. Additionally, the term "step" can be utilized interchangeably with "instruction" or "operation".

Unless defined otherwise, all technical and scientific terms used herein have the same meanings as commonly understood by one of ordinary skill in the art. As used in this document, the term "comprising" means "including, but not limited to."

Figure 4:
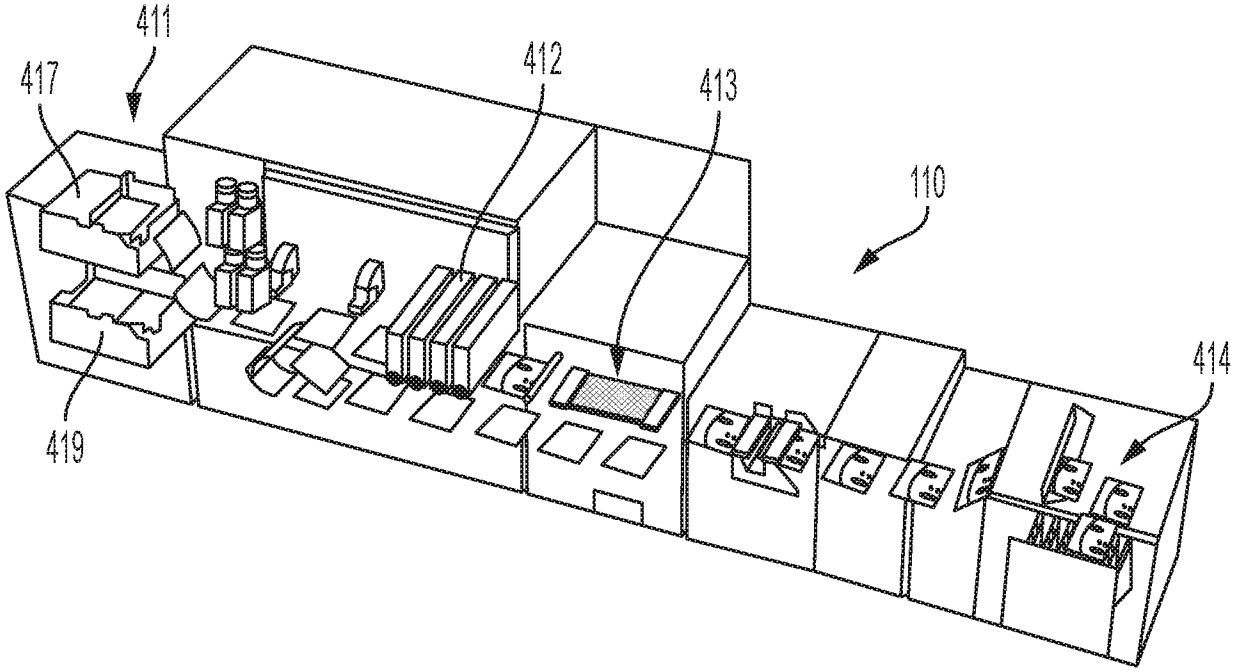
FIG. 4 illustrates a pictorial diagram depicting an example printing system in which an embodiment may be implemented.

The term "printing system" as utilized herein can relate to a printer, including digital printing devices and systems that accept text and graphic output from a computing device, electronic device or data processing system and transfers the information to a substrate such as paper, usually to standard size sheets of paper. A printing system may vary in size, speed, sophistication, and cost. In general, more expensive printers are used for higher-resolution printing. A printing system can render images on print media, such as paper or other substrates, and can be a copier, laser printer, bookmaking machine, facsimile, or a multifunction machine (which can include one or more functions such as scanning, printing, archiving, emailing, faxing and so on). An example of a printing system that can be adapted for use with one or more embodiments is shown in FIG. 4.

The term "transport belt" as utilized herein can relate to a belt implemented in a printing system in association in with a rotatable member such as a roller or other transport members or web transport configurations. Such a transport belt can also be referred to as a "marker belt" and related to marking transport or marker transport, which may become contaminated with aqueous ink. To permit a high registration accuracy, a printing system can employ such a transport belt, which in some implementations can pass in front of toner cartridges and each of the toner layers can be precisely applied to the transport belt. The combined layers can be then applied to the paper in a uniform single step. It should be appreciated, however, that the disclosed embodiments are not limited to printers that utilize toner. Ink and other types of marking media may be utilized in other printing embodiments. That is, a printing system is not limited to a laser printing implementation but may be realized in other contexts, such as ink-jet printing systems.

A "computing device" or "electronic device" or "data processing system" refers to a device or system that includes a processor and non-transitory, computer-readable memory. The memory may contain programming instructions that, when executed by the processor, cause the computing device to perform one or more operations according to the programming instructions. As used in this description, a "computing device" or "electronic device" may be a single device, or any number of devices having one or more processors that communicate with each other and share data and/or instructions. Examples of computing devices or electronic devices include, without limitation, personal computers, servers, mainframes, gaming systems, televisions, and portable electronic devices such as smartphones, personal digital assistants, cameras, tablet computers, laptop computers, media players and the like. Various elements of an example of a computing device or processor are described below in reference to FIGS. 1-3.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

Figure 2:
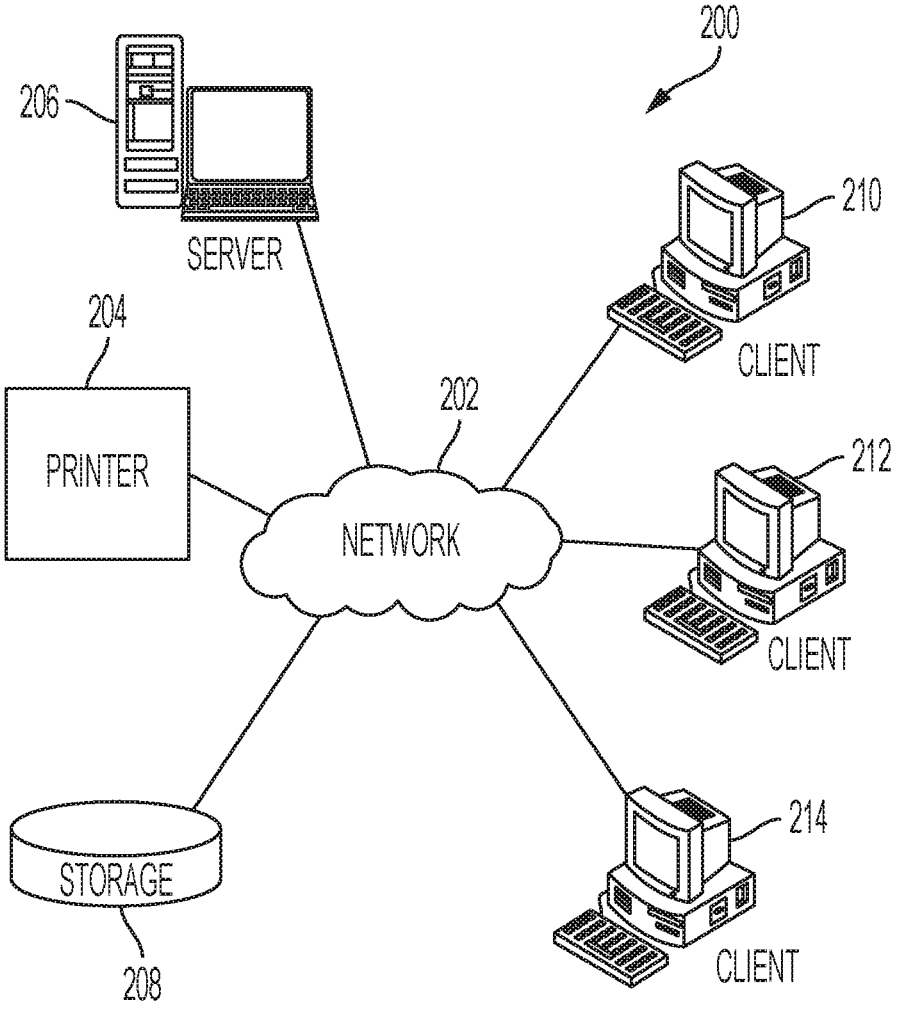
FIG. 2 depicts a graphical representation of a network of data-processing devices in which aspects of the present embodiments may be implemented.
Figure 3:
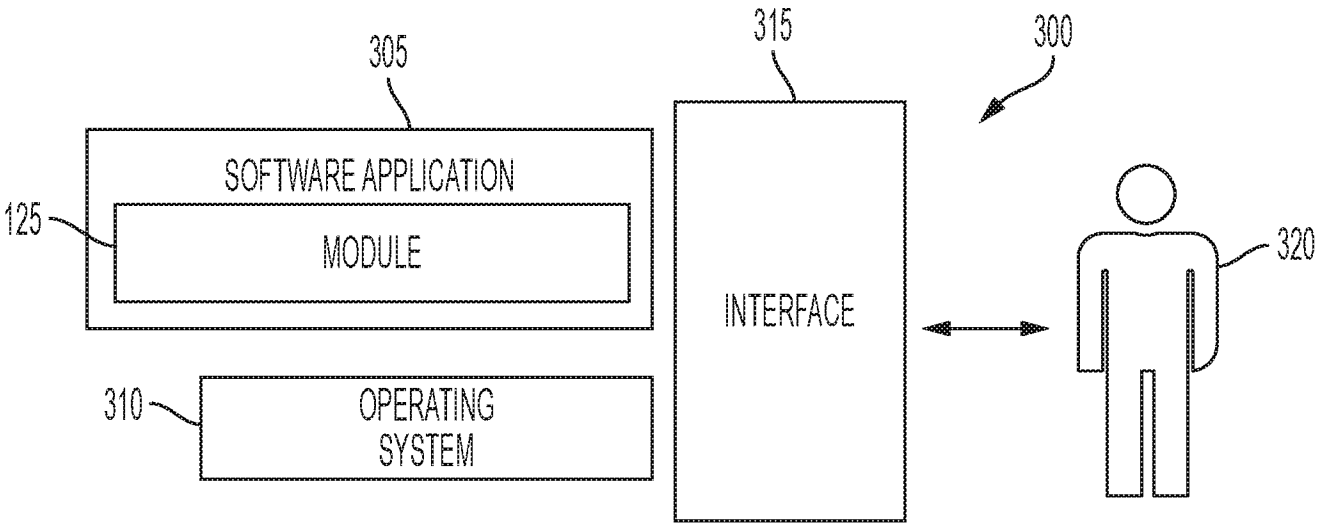
FIG. 3 illustrates a computer software system for directing the operation of the data-processing system depicted in FIG. 1, in accordance with an example embodiment.

FIGS. 1-3 are provided as exemplary diagrams of data-processing environments in which embodiments of the present invention may be implemented. It should be appreciated that FIGS. 1-3 are only exemplary and are not intended to assert or imply any limitation with regard to the environments in which aspects or embodiments of the disclosed embodiments may be implemented. Many modifications to the depicted environments may be made without departing from the spirit and scope of the disclosed embodiments.

A block diagram of a computer system 100 that executes programming for implementing parts of the methods and systems disclosed herein is shown in FIG. 1. A computing device in the form of a computer 110 configured to interface with controllers, peripheral devices, and other elements disclosed herein may include one or more processing units 102, memory 104, removable storage 112, and non-removable storage 114. Memory 104 may include volatile memory 106 and non-volatile memory 108. Computer 110 may include or have access to a computing environment that includes a variety of transitory and non-transitory computer-readable media such as volatile memory 106 and non-volatile memory 108, removable storage 112 and non-removable storage 114. Computer storage as described herein can include, for example, disc storage, disk storage, random access memory (RAM), read only memory (ROM), erasable programmable read-only memory (EPROM) and electrically erasable programmable read-only memory (EEPROM), flash memory or other memory technologies, compact disc read-only memory (CD ROM), Digital Versatile Discs (DVD) or other optical disc storage, magnetic cassettes, magnetic tape, magnetic disk storage, or other magnetic storage devices, or any other medium capable of storing computer-readable instructions as well as data including image data.

Computer 110 may include, or have access to, a computing environment that includes input 116, output 118, and a communication connection 120. The computer may operate in a networked environment using a communication connection 120 to connect to one or more remote computers, remote sensors and/or controllers, detection devices, handheld devices, multi-function devices (MFDs), speakers, mobile devices, tablet devices, mobile phones, Smartphone, or other such devices. The remote computer may also include a personal computer (PC), server, router, network PC, RFID enabled device, a peer device or other common network node, or the like. The communication connection 120 may include a Local Area Network (LAN), a Wide Area Network (WAN), Bluetooth connection, or other networks. This functionality is described more fully in the description associated with FIG. 2 below.

Output 118 is most commonly provided as a computer monitor, but may include any output device. Output 118 and/or input 116 may include a data collection apparatus associated with computer system 100. In addition, input 116, which commonly includes a computer keyboard and/or pointing device such as a computer mouse, computer track pad, or the like, allows a user to select and instruct computer system 100. A user interface can be provided using output 118 and input 116. Output 118 may function as a display for displaying data and information for a user, and for interactively displaying a graphical user interface (GUI) 130.

Note that the term "GUI" generally refers to a type of environment that represents programs, files, options, and so forth by means of graphically displayed icons, menus, and dialog boxes on a computer monitor screen. A user can interact with the GUI to select and activate such options by directly touching the screen and/or pointing and clicking with a user input device, such as input 116 which can be embodied, for example, as a pointing device such as a mouse, and/or with a keyboard. A particular item can function in the same manner to the user in all applications because the GUI 130 can provide standard software routines (e.g., module 125) to handle these elements and report the user's actions. The GUI 130 can further be used to display the electronic service image frames as discussed below.

Computer-readable instructions, for example, program module or node 125, which can be representative of other modules or nodes described herein, are stored on a computer-readable medium and are executable by the processing unit 102 of computer 110. Program module or node 125 may include a computer application. A hard drive, CD-ROM, RAM, Flash Memory, and a USB drive are just some examples of articles including a computer-readable medium.

FIG. 2 depicts a graphical representation of a network of data-processing systems 200 in which aspects of the present invention may be implemented. Network data-processing system 200 can be a network of computers or other such devices, such as mobile phones, smart phones, sensors, controllers, speakers, tactile devices, and the like, in which embodiments of the present invention may be implemented. Note that the system data-processing system 200 can be implemented in the context of a software module, such as module 125. The data-processing system 200 includes a network 202 in communication with one or more clients 210, 212, and 214. Network 202 may also be in communication with one or more printing devices 204, servers 206, and storage 208. Network 202 is a medium that can be used to provide communications links between various devices and computers connected together within a networked data processing system such as computer system 100. Network 202 may include connections such as wired communication links, wireless communication links of various types, and fiber optic cables. Network 202 can communicate with one or more servers 206, one or more external devices such as multifunction device or printer 204, and storage 208, such as a memory storage unit, for example, a memory or database. It should be understood that printing device 204 may be embodied as a printer, copier, fax machine, scanner, multi-function device, rendering machine, photo-copying machine, or other such rendering device.

In the depicted example, printer 204, server 206, and clients 210, 212, and 214 connect to network 202 along with storage 208. Clients 210, 212, and 214 may be, for example, personal computers or network computers, handheld devices, mobile devices, tablet devices, smart phones, personal digital assistants, printing devices, recording devices, speakers, MFDs, etc. Computer system 100 depicted in FIG. 1 can be, for example, a client such as client 210 and/or 212 and/or 214.

Computer system 100 can also be implemented as a server such as server 206, depending upon design considerations. In the depicted example, server 206 provides data such as boot files, operating system images, applications, and application updates to clients 210, 212, and/or 214. Clients 210, 212, and 214 and printing device 204 are clients to server 206 in this example. Network data-processing system 200 may include additional servers, clients, and other devices not shown. Specifically, clients may connect to any member of a network of servers, which provide equivalent content.

In the depicted example, network data-processing system 200 is the Internet, with network 202 representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers consisting of thousands of commercial, government, educational, and other computer systems that route data and messages. Of course, network data-processing system 200 may also be implemented as a number of different types of networks such as, for example, an intranet, a local area network (LAN), or a wide area network (WAN). FIGS. 1 and 2 are intended as examples and not as architectural limitations for different embodiments of the present invention.

FIG. 3 illustrates a software system 300, which may be employed for directing the operation of the data-processing systems such as computer system 100 depicted in FIG. 1. Software application 305, may be stored in memory 104, on removable storage 112, or on non-removable storage 114 shown in FIG. 1, and generally includes and/or is associated with a kernel or operating system 310 and a shell or interface 315. One or more application programs, such as module(s) or node(s) 125, may be "loaded" (i.e., transferred from removable storage 114 into the memory 104) for execution by the computer system 100. The computer system 100 can receive user commands and data through interface 315, which can include input 116 and output 118, accessible by a user 320. These inputs may then be acted upon by the computer system 100 in accordance with instructions from operating system 310 and/or software application 305 and any software module(s) 125 thereof.

Generally, program modules (e.g., module 125) can include, but are not limited to, routines, subroutines, software applications, programs, objects, components, data structures, etc., that perform particular tasks or implement particular abstract data types and instructions. Moreover, those skilled in the art will appreciate that elements of the disclosed methods and systems may be practiced with other computer system configurations such as, for example, hand-held devices, mobile phones, smart phones, tablet devices multi-processor systems, microcontrollers, printers, copiers, fax machines, multi-function devices, data networks, microprocessor-based or programmable consumer electronics, networked personal computers, minicomputers, mainframe computers, servers, medical equipment, medical devices, and the like.

Note that the term "module" or "node" as utilized herein may refer to a collection of routines and data structures that perform a particular task or implements a particular abstract data type. Modules may be composed of two parts: an interface, which lists the constants, data types, variables, and routines that can be accessed by other modules or routines; and an implementation, which is typically private (accessible only to that module) and which includes source code that actually implements the routines in the module. The term module may also simply refer to an application such as a computer program designed to assist in the performance of a specific task such as word processing, accounting, inventory management, etc., or a hardware component designed to equivalently assist in the performance of a task.

The module 125 may include instructions (e.g., steps or operations) for performing operations such as those that will be further discussed herein. For example, module 125 can provide instructions for operating the apparatus 800 shown in FIG. 8. Module 125 may also include instructions for implementing a method of in-situ cleaning of vacuum belt transports that can include the controlled movement of a cleaning web disposed between a marking platen and a transport belt.

The interface 315 (e.g., a graphical user interface 130) can serve to display results, whereupon a user 320 may supply additional inputs or terminate a particular session. In some embodiments, operating system 310 and GUI 130 can be implemented in the context of a "windows" type system, such as Microsoft Windows®. It can be appreciated, of course, that other types of systems are possible. For example, rather than a traditional "windows" system, other operation systems such as, for example, a real-time operating system (RTOS) more commonly employed in wireless systems may also be employed with respect to operating system 310 and interface 315. The software application 305 can include, for example, module(s) 125, which can include instructions for carrying out steps or logical operations such as those shown and described herein.

The following description is presented with respect to embodiments of the present invention, which can be embodied in the context of, or require the use of, a data-processing system such as computer system 100, in conjunction with program module 125, and data-processing system 200 and network 202 depicted in FIGS. 1-3. The present invention, however, is not limited to any particular application or any particular environment. Instead, those skilled in the art will find that the system and method of the present invention may be advantageously applied to a variety of system and application software including database management systems, rendering devices, word processors, and the like. Moreover, the present invention may be embodied on a variety of different platforms including Windows, Macintosh, UNIX, LINUX, Android, Arduino and the like. Therefore, the descriptions of the exemplary embodiments, which follow, are for purposes of illustration and not considered a limitation.

FIG. 4 illustrates a pictorial diagram depicting an example printing system 110 in which an embodiment may be implemented. That is, the apparatus 500 shown in FIGS. 8-9, for example, can be implemented in the printing system 110. In some embodiments, the printing system 110 can be implemented as an aqueous inkjet printer. The printing system 110 shown in FIG. 4 can include a number of sections or modules, such as, for example, a sheet feed module 411, a print head and ink assembly module 412, a dryer module 413 and a production stacker 414. Such modules can be composed of physical hardware components, but in some cases may include the use of software or may be subject to software instructions.

It should be appreciated that the printing system 110 depicted in FIG. 4 represents one example of an aqueous inkjet printer that can be adapted for use with one or more embodiments. The particular configuration and features shown in FIG. 4 should not be considered limiting features of the disclosed embodiments. That is, other types of printers can be implemented in accordance with different embodiments. For example, the printing system 110 depicted in FIG. 4 can be configured as a printer that uses water-based inks or solvent-based inks, or in some cases may utilize toner ink in the context of a LaserJet printing embodiment.

In an embodiment, the sheet feed module 411 of the printing system 110 can be configured to hold, for example, 2,500 sheets of 90 gsm, 4.0 caliper stock in each of two trays. With 5,000 sheets per unit and up to 4 possible feeders in such a configuration, 20,000 sheets of non-stop production activity can be facilitated by the printing system 110. The sheet feed module can include an upper tray 17 that holds, for example, paper sizes 8.27"×10"/210 mm×254 mm to 14.33"×20.5"/364 mm×521 mm, while a lower tray 19 can hold paper sizes ranging from, for example, 7"×10"/178 mm×254 mm to 14.33"×20.5"/364 mm×521 mm. Each feeder can utilize a shuttle vacuum feed head to pick a sheet off the top of the stack and deliver it to a transport mechanism.

The print head and ink assembly module 412 of the printing system 110 can include, for example a plurality of inkjet print heads that deliver four different drop sizes through, for example, 7,870 nozzles per color to produce prints with, for example, a 600×600 dpi. An integrated full-width scanner can enable automated print head adjustments, missing jet correction and image-on-paper registration. Operators can make image quality improvements for special jobs such as edge enhancement, trapping, and black overprint. At all times automated checks and preventative measures can maintain the press in a ready state and operational.

The dryer module 413 of the printing system 110 can include a dryer. After printing, the sheets can move directly into a dryer where the paper and ink are heated with seven infrared carbon lamps to about 90° C. (194° F.). This process removes moisture from the paper so the sheets are stiff enough to move efficiently through the paper path. The drying process also removes moisture from the ink to prevent it from rubbing off. A combination of sensors, thermostats, thermistors, thermopiles, and blowers accurately heat these fast-moving sheets, and maintain rated print speed.

The production stacker 414 can include a finisher that can run over a period of time as it delivers up to 2,850 sheets at a time. Once unloaded, the stack tray can return to a main stack area to pick and deliver another load. The stacker 414 can provide an adjustable waist-height for unloading from, for example, 8" to 24", and a by-pass path with the ability to rotate sheets to downstream devices. The production stacker 414 can also be configured with, for example, a 250-sheet top tray for sheet purge and samples, and can further include an optional production media cart to ease stack transport. One non-limiting example of printing system 110 is the Xerox® Brenva® HD Production Inkjet Press, a printing product of Xerox Corporation. Such a printing system can include transport members such as the transport belts discussed herein and/or other features including for example a Brenva®/Fervent® marking transport, which is also a product of Xerox Corporation.

Figure 5:
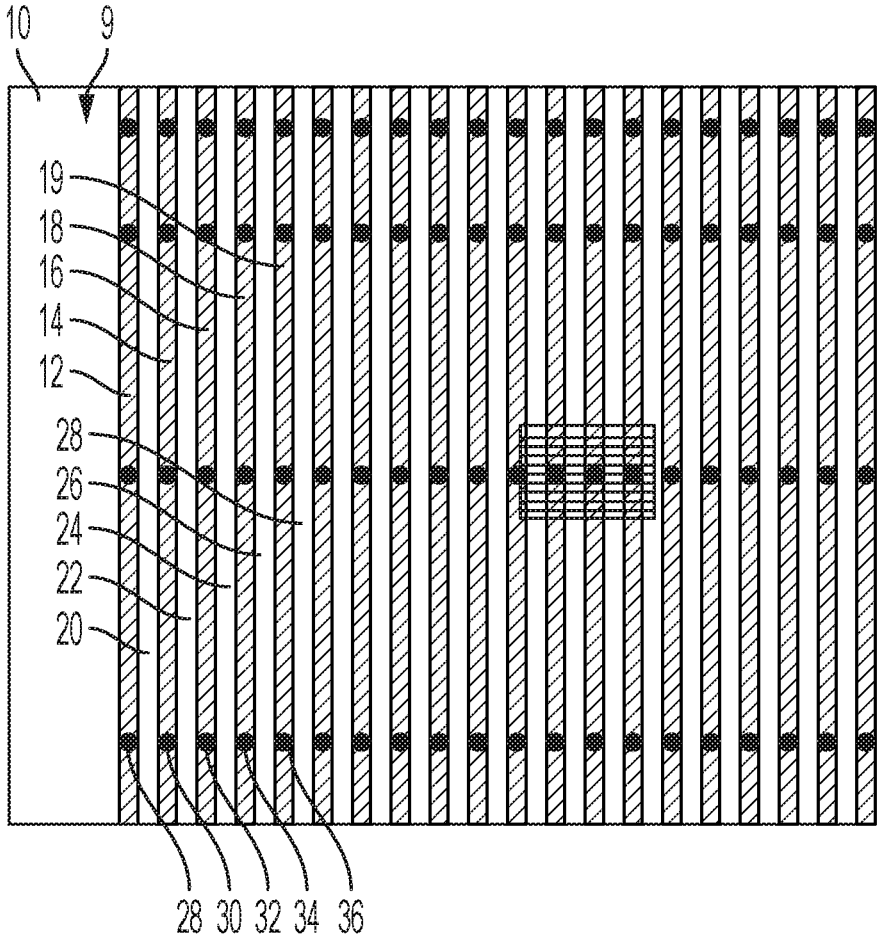
FIG. 5 illustrates a screen shot of the top view of a marker platen, in accordance with an embodiment.

FIG. 5 illustrates a screen shot of the top view of a marker platen 10, in accordance with an embodiment. As shown in FIG. 5 the marker platen 10 can include a vacuum channel 12, a vacuum channel 14, a vacuum channel 16, a vacuum channel 18, and a vacuum channel 19. The marker platen 10 can further include one or more landing areas including a landing area 20, a landing area 22, a landing area 24, a landing area 26, and a landing area 28, and so on where a transport belt 39 (shown in FIG. 6) can ride. The marker platen 10 can also include one or more vacuum ports including a vacuum port 29, a vacuum port 30, a vacuum port 32, a vacuum port 34, and a vacuum port 36, and so on, which can feed the vacuum channel 12, the vacuum channel 14, the vacuum channel 16, the vacuum channel 18, the vacuum channel 19 and so on. It can be appreciated that additional or fewer vacuum channels, landing areas and vacuum ports can be implemented, and that any specific number of such vacuum channels, landing areas and vacuum ports are not limiting features of the disclosed embodiments.

Figure 6:
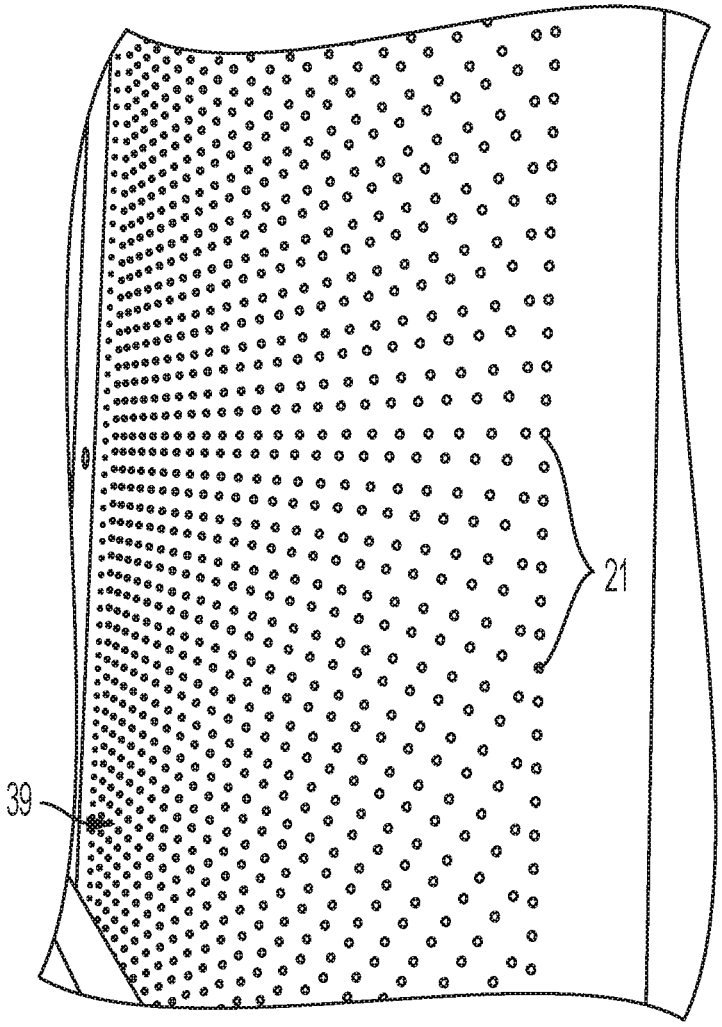
FIG. 6 illustrates a photograph of a transport belt, in accordance with an embodiment.

FIG. 6 illustrates a screen shot of a transport belt 39, in accordance with an embodiment. The transport belt 39 (marker belt) can ride on top of the marker platen 10, and can be configured with vacuum holes spaced periodically, and which can be aligned with the vacuum channels.

Figure 7:
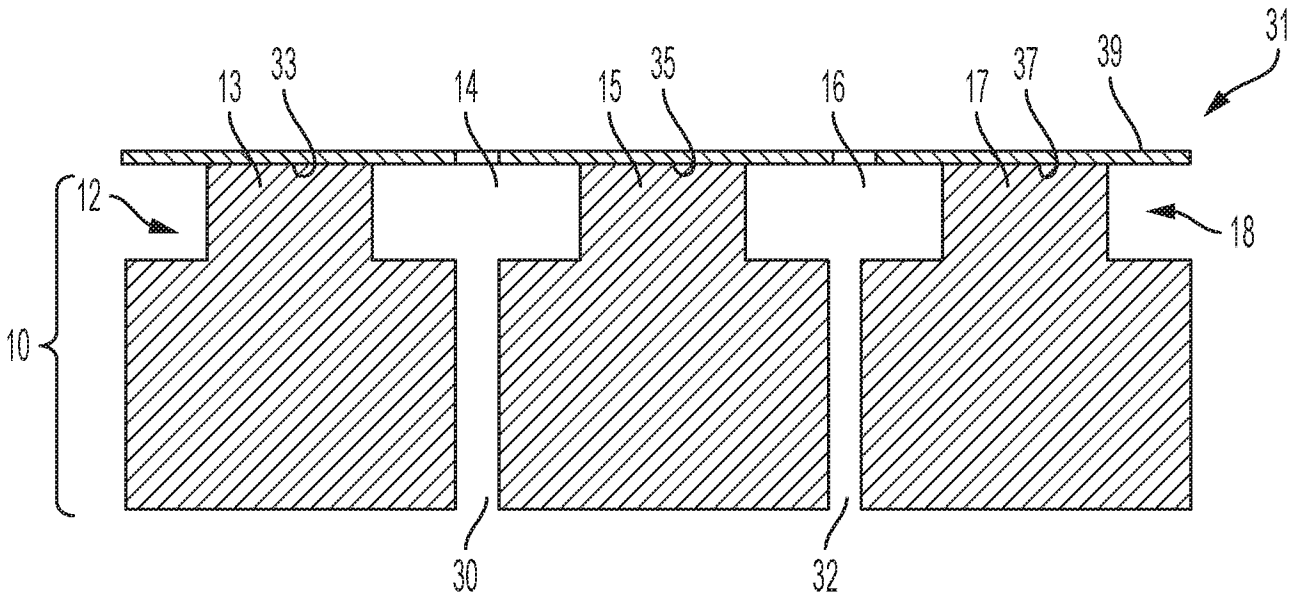
FIG. 7 illustrates a block diagram depicting a side sectional view of an apparatus that includes the marker platen and the transport belt, in accordance with an embodiment.

FIG. 7 illustrates a block diagram depicting a side sectional view of an apparatus 31 that includes the marker platen 10 and the transport belt 39, in accordance with an embodiment. It can be appreciated that the apparatus 31 can be incorporated into a printing system. As shown in FIG. 3, the vacuum channel 12, the vacuum channel 14, the vacuum channel 16, the vacuum channel 18, and the vacuum channel 19 can be disposed below the transport belt 39. The apparatus 31 can include one or more guides including a topside marker platen surface guide 13, a topside marker platen surface guide 15, and a topside marker platen surface guide 17.

Figure 8:
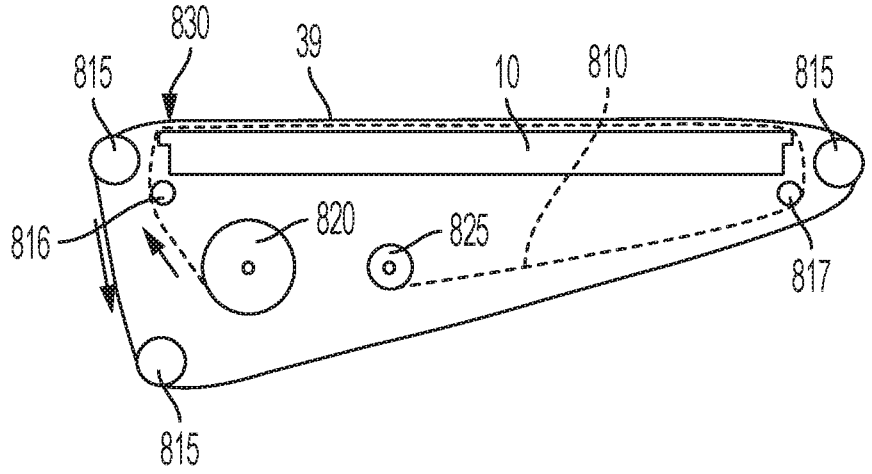
FIG. 8 illustrates a block diagram depicting a side sectional view of an apparatus that includes a cleaning web disposed between a marker platen and a transport belt, in accordance with an embodiment.

Ink contamination areas can be located along the transport belt 39 or at the top surface of the marker platen 10 shown in FIG. 8. In fact, the contact areas between the transport belt 39 and edges of the marker platen 10 can be the area most likely to suffer from ink contamination resulting in excessive frictional drag. As this ink contaminant experiences drying over an extended period of time, the water content in it decreases while the concentration of co-solvents and other high boiling additives (e.g. glycols) remains constant. Consequently, the ink contaminant may be more likely to behave like a high viscosity fluid during these times. Such circumstances can increase the drag force between the transport belt 39 and the marker platen 10 and may lead to drive force failure.

The embodiments disclosed herein are drawn to methods and systems for cleaning components in a rendering device. In one such embodiment, an in-situ cleaning web 810 shown in the system 800 depicted in FIG. 8 is described. Referring to the system 800 in FIG. 8, a cleaning web 810 can be placed between the marker platen 10 and the transport belt 39. The cleaning web 810 can move from a supply spool 820, over a supply roller 816, over the marker platen 10, then over a wrap roller 817 into a take-up spool 825 in a direction opposite to the motion of the transport belt 39, as indicated by direction arrows. The cleaning web 810 can be moved continuously while printing or intermittently between printing jobs. The cleaning web 810 can keep ink off the marker platen 10, catching directly as any stray ink passes through holes in the transport belt 39. Since the cleaning web 810 is always present, the transport belt 39 should stay cleaner in general and thus rollers 815 moving in association with the transport belt 39 should stay cleaner, compare to the present state. The motion of the cleaning web 810 would ideally be in the opposite direction to the motion of the transport belt 39 primarily to simplify the web drive system. Furthermore, the transport belt 39 would contact the cleanest portion 830 of the cleaning web 810 as the transport belt 39 is exiting the marker platen 10 surface area. Speed of the cleaning web belt 810 and the transport belt 39 can be managed/controlled electromechanically using computer systems as described in FIGS. 1-3.

Continuous motion while printing can be most preferred from a cleaning point of view. Speed can be very slow, about 3.6 mm/min, equivalent to the slow web speed used in the iGen fuser 20 micon per 8.5" long print. A 120 mm diameter spool of 40 micron thick web (thin, but is quite reasonable at these low temperatures) would be 252 m long. At 3.6 mm/min it would last 1168 hours or 97 12-hour days. Bigger spools of cleaning web 10 are reasonable taking advantage of the fact that the supply & take up spool are not large at the same time. In this example the minimum allowed center-to-center distance between the supply spool 820 and take-up spool 825 is 89.6 mm. And cleaning web 10 length increases rapidly as the supply spool 820 diameter increases. For example: 100 mm diameter; 186 m length, 120D; 252L, 150D; 354L, 200D; 522L. A 200 mm diameter supply spool will last 2420 hours at the speed mentioned above.

Wear of the marker platen 10 would be drastically reduced since the transport belt 39 can now slide on the cleaning web 810, not the marker platen 10. The speed that the cleaning web 810 is running over the marker platen 10 can be adjustable so that it is extremely low. As previously mentioned, speed can be controlled electromechanically using systems as described in FIGS. 1-3. The cleaning web 810 can be subjected to wear for 4.6 hours at the assumed speed and assumed platen length of 1 m. Coefficient of friction of the transport belt 39 on the cleaning web 810 can be lower than the transport belt 39 on the marker platen 10, leading to greater drive force latitude. Motion quality impact of a nearly stationary cleaning web 810 versus a stationary marker platen 10 are not expected to be perceptible.

Figure 9:
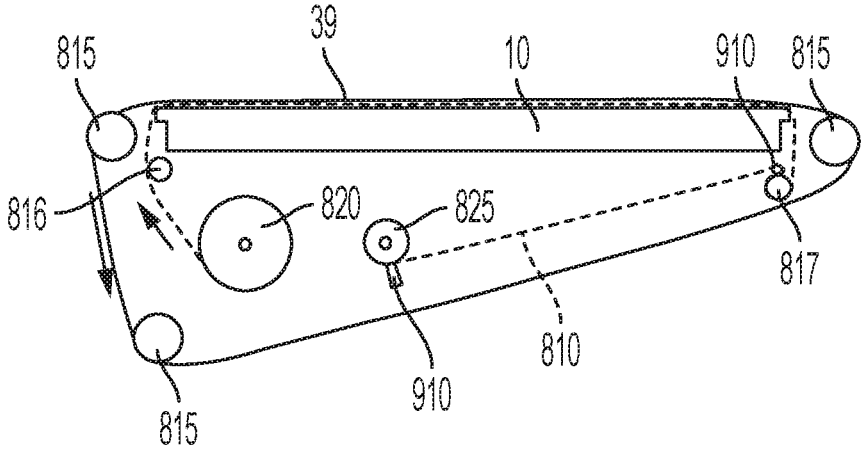
FIG. 9 illustrates a block diagram depicting a side sectional view of an apparatus that includes the marker platen, a transport belt, a cleaning web disposed there-between, and a means to adjust and control the cleaning web, in accordance with an embodiment.

Referring to the system 900 in FIG. 9, a constant velocity capstan drive 910 can be employed to control cleaning web speed and minimize possible speed disturbance of the transport belt 39. The capstan drive 910 can be driven via a large gear reduction (about 4500:1) at a uniform speed as the diameter of the take-up spool 825 is increased. A slip clutch 915 can be employed to provide a constant torque to the take-up spool 825 to keep tension on the capstan drive 910 and wind up the take-up spool 825. The ratio of the core diameter to the large take-up spool 825 diameter should not exceed about 7 to 10, or else the starting clutch torque may be too high causing the cleaning web 810 to slide forward over the capstan drive 910, or the tension may be too low with a large take-up spool 825 and the friction of the belt 39 on the cleaning web 810 may move the cleaning web 810 backwards. The capstan drive 910 and slip clutch can be electromechanically controlled by the system as described in FIGS. 1-3.

Alternatively, the take-up spool 825 can be driven directly with a gear reduced motor (not shown, but represented by the capstan 910 area) and can be duty cycled at a varying period to approximate a slow uninform cleaning web speed. This method can be simpler in hardware and more complex in software. And the cleaning web 810 may not be moving some of the time and can be moving somewhat fast at other times.

In the case of an ink spill, a few meters of cleaning web 810 could be feed rapidly with manual watering from above through holes formed in the transport belt 39. The gear ratio may need to be changed. This can be accomplished by providing a second motor (not shown), or by providing a manual hand crank (not shown), to enable a much faster feed rate. Alternatively, the cleaning web 810 could only be moved at cycle out or some selectable interval during pauses in printing. Presumably it could be advanced only a 5-20% the length of the marker transport at a time. Additionally, the cleaning web 810 can work in conjunction with a manual wetting operation. The operator can use a damp sponge (not shown) to clean the outer surface of the transport belt 39 as it is moving but keep the sponge at the upstream end of the transport belt 39. Water from the sponge would dampen the cleaning web 810 on the inside of the transport belt 39, over the upstream portion by about 10%. The rest of the cleaning web 810 can clean and dry the inside of the transport belt 39. At the end of the cleaning cycle the cleaning web 810 could be rapidly advanced about 25% the length of the marker platen 10.

Figure 10A:
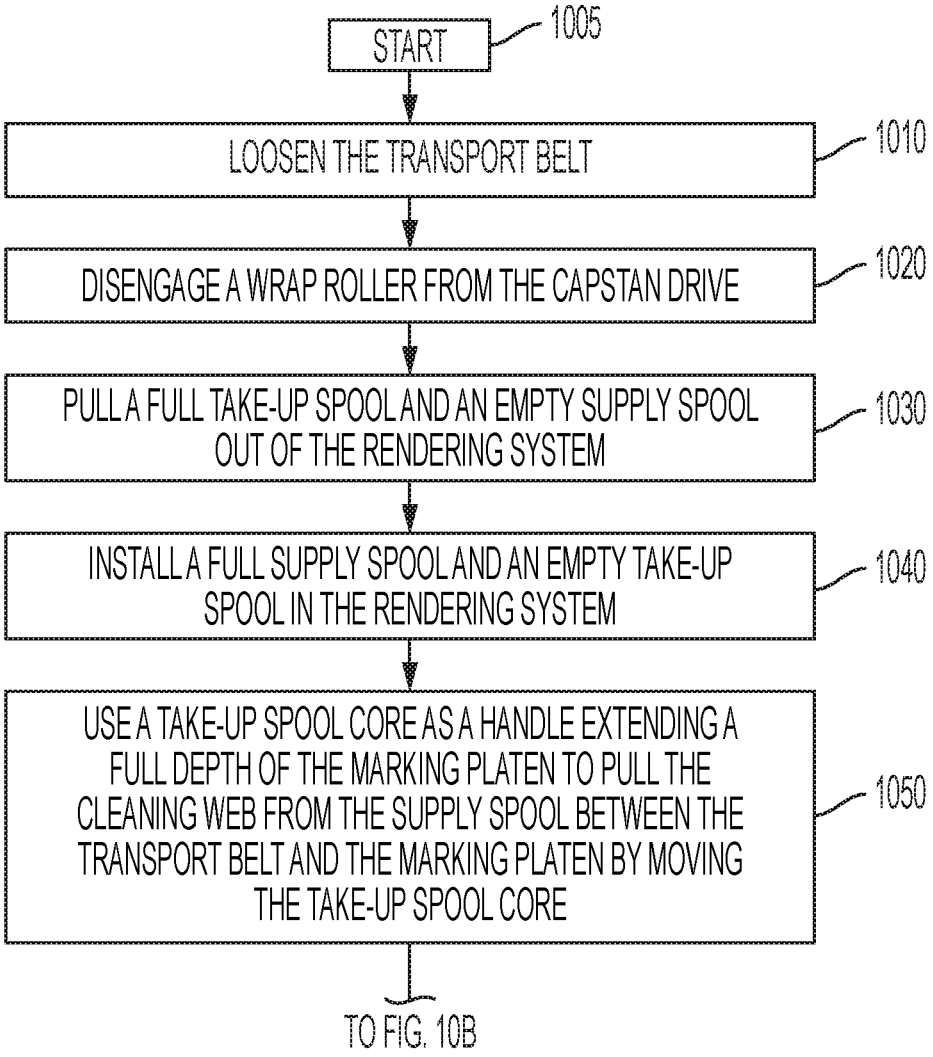
Figure 10B:
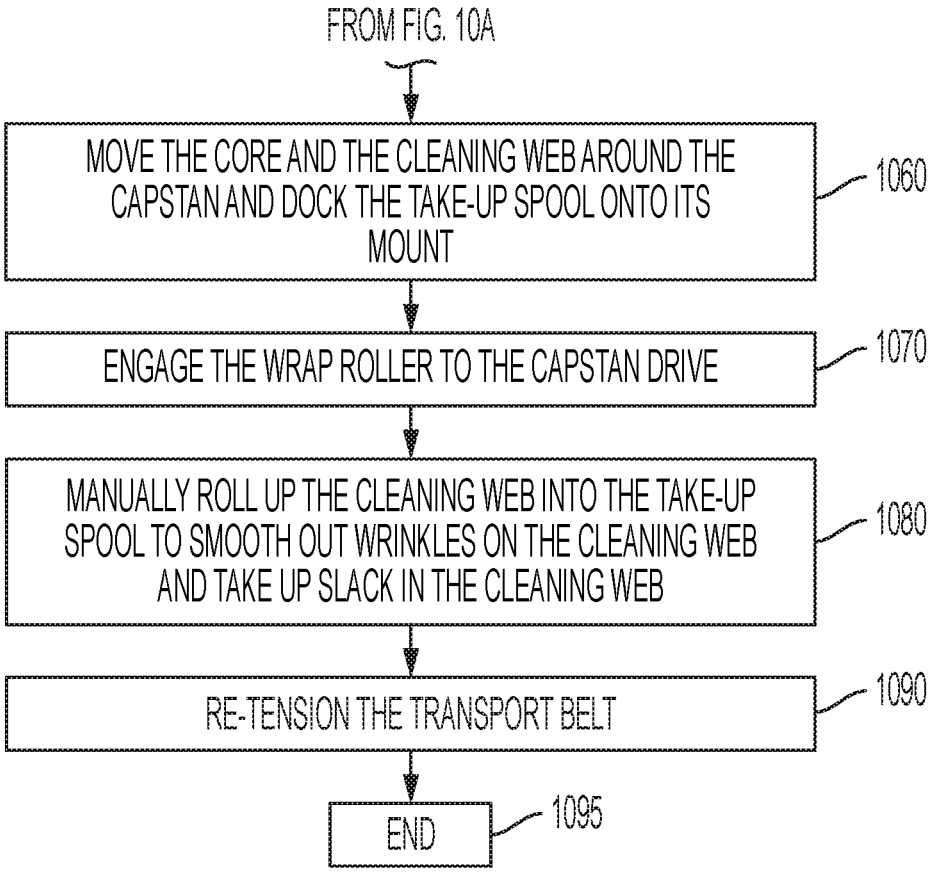

Referring to FIGS. 10A and 10B, wherein FIG. 10B is a continuation of steps from FIG. 10A, illustrated is a method 1000 for facilitating the in-situ cleaning of rendering devices by replacing cleaning webs, in accordance with the disclosed embodiments. The method begins at 1005. Referring to FIG. 10A, replacing the cleaning web 810 can be accomplished with the transport belt 39 in the following manor: The transport belt 39 can be loosened as shown in Block 1010. It will likely be loosened about 20 mm or more by movement of one of the rollers 815. As shown in Block 1020, a wrap roller 817 can be disengaged from the capstan drive 910. The full take-up spool 825 and empty supply spool 820 can then be pulled forward and out the front of the machine 110, as shown in Block 1030. The span of web on the platen may wrinkle and bunch up, but this is okay. Then as shown in Block 1040, the full supply spool (i.e., replacing supply spool 820 at same location) is installed on its spool support. Then, the take-up spool 825 core can be used as a handle that extends the full depth of the transport to pull the cleaning web 810 (gradually being pulled out of the supply spool) between the transport belt 39 and the marking platen 10 by moving the take-up spool 825 core, as shown in Block 1050. Then, referring to FIG. 10B, which as mentioned above illustrates a continuation of the process from FIG. 10A, as shown in Block 1060, the cleaning spool 825 core (and attached cleaning web) can be moved around the wrap roller 817, and capstan drive 910 (if provided) and docked on its spool support. Then, as shown in Block 1070, the wrap roller is engaged to the capstan drive 910 (when supplied and used). Some of the cleaning web 910 can be manually rolled up to smooth out wrinkles and take up slack, as shown in Block 1080. Then as shown in Block 1090, the transport belt 39 can be re-tensioned. Then as shown in Block 1095, the process ends and the cleaning web 910 is located between the transport belt 39 and marker platen 10 and is readied for operation.

Based on the foregoing, it can be appreciated that a number of embodiments are disclosed herein. In one embodiment, A system for maintaining rendering systems can be implemented, which can include a marker platen having a top surface and a bottom; a transport belt configured to move in a first direction over the top surface of the marker platen; and a cleaning web configured to move between the top surface of the marker platen and the transport belt to remove ink from the transport belt and the marker platen.

In an embodiment, the cleaning web can be further configured to move between the top surface of the marker platen and the transport belt in an opposite direction to the first direction of the transport belt.

In yet another embodiment, the cleaning web can be configured to move from a supply spool over the top surface of the marker platen and between the marker platen and the transport belt to a take-up spool.

In another embodiment, a constant velocity capstan drive can be employed to control speed of the cleaning web as it moves from a supply spool over the top surface of the marker platen and between the marker platen and the transport belt into a take-up spool.

In an embodiment of such a system, a slip clutch configured to provide constant torque to the take-up spool and maintain tension on the constant velocity capstan drive as the cleaning web is wound into the take-up spool.

In another embodiment, a method for in-situ cleaning of a rendering device can include providing a controller in a rendering device configured to move a transport belt in a first direction over a top surface of a marker platen, and move a cleaning web from a supply spool over the top surface of a marker platen between the transport belt and the maker platen into a take-up spool in an opposite direction to the first direction. The cleaning web removes ink from the transport belt and the marker platen.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A system for maintaining rendering systems, comprising:

a marker platen having a top surface and a bottom;

a transport belt configured to move in a first direction over the top surface of the marker platen; and a cleaning web configured to move between the top surface of the marker platen and the transport belt to remove ink from the transport belt and the marker platen.

2. The system of claim 1, wherein the cleaning web is further configured to move between the top surface of the marker platen and the transport belt in an opposite direction to the first direction of the transport belt.

3. The system of claim 2, wherein the cleaning web is configured to move from a supply spool over the top surface of the marker platen and between the marker platen and the transport belt to a take-up spool.

4. The system of claim 1, wherein the cleaning web is configured to move from a supply spool over the top surface of the marker platen and between the marker platen and the transport belt to a take-up spool.

5. The system of claim 4, wherein the cleaning web is further configured to move between the top surface of the marker platen and the transport belt in an opposite direction to the first direction of the transport belt.

6. The apparatus of claim 1, further comprising a constant velocity capstan drive employed to control speed of the cleaning web as it moves from a supply spool over the top surface of the marker platen and between the marker platen and the transport belt into a take-up spool.

7. The apparatus of claim 6, wherein the constant velocity capstan drive is driven via a gear reduction set to attain a uniform speed as a diameter of the take-up spool is increased.

8. The apparatus of claim 7, further comprising a slip clutch configured to provide constant torque to the take-up spool and maintain tension on the constant velocity capstan drive as the cleaning web is wound into the take-up spool.

9. The apparatus of claim 1 wherein the marker platen comprises a plurality of landing areas upon which a transport belt rides.

10. A system for maintaining rendering systems, comprising:

a marker platen having a top surface and a bottom;

a transport belt configured to move in a first direction over the top surface of the marker platen; and a cleaning web configured to move from a supply spool over the top surface of the marker platen and between the marker platen and the transport belt to a take-up spool, wherein the cleaning web moves in an opposite direction to the first direction of the transport belt to remove ink from the transport belt and the marker platen.

11. The system of claim 10, further comprising a constant velocity capstan drive employed to control speed of the cleaning web as it moves from a supply spool over the top surface of the marker platen and between the marker platen and the transport belt into a take-up spool.

12. The apparatus of claim 11, wherein the constant velocity capstan drive is driven via a gear reduction set to attain a uniform speed as a diameter of the take-up spool is increased.

13. The apparatus of claim 12, further comprising a slip clutch configured to provide constant torque to the take-up spool and maintain tension on the constant velocity capstan drive as the cleaning web is wound into the take-up spool.

14. The apparatus of claim 11, further comprising a slip clutch configured to provide constant torque to the take-up spool and maintain tension on the constant velocity capstan drive as the cleaning web is wound into the take-up spool.

15. A method for in-situ cleaning of a rendering device, comprising:

providing a controller in a rendering device configured to:

move a transport belt in a first direction over a top surface of a marker platen; and move a cleaning web from a supply spool over the top surface of a marker platen between the transport belt and the maker platen into a take-up spool in an opposite direction to the first direction, wherein the cleaning web removes ink from the transport belt and the marker platen.

16. The method of claim 15, further comprising providing a constant velocity capstan drive employed to control speed of the cleaning web as it moves from the supply spool over the top surface of the marker platen and between the marker platen and the transport belt into the take-up spool.

17. The method of claim 16, wherein the constant velocity capstan drive is driven via a gear reduction set to attain a uniform speed as a diameter of the take-up spool is increased.

18. The method of claim 17, further comprising providing a slip clutch configured to provide constant torque to the take-up spool and maintain tension on the constant velocity capstan drive as the cleaning web is wound into the take-up spool.

19. The method of claim 16, further comprising steps of replacing the cleaning web in the rendering system including:

loosen the transport belt;

disengage a wrap roller from the constant velocity capstan drive;

pull a full take-up spool and an empty supply spool out of the rendering system;

install a full supply spool and an empty take-up spool in the rendering system;

use a take-up spool core as a handle extending a full depth of the marking platen to pull the cleaning web from the supply spool between the transport belt and the marking platen by moving the take-up spool core;

move the core and the cleaning web around the constant velocity capstan drive and dock the take-up spool onto its mount;

engage the wrap roller to the constant velocity capstan drive;

manually roll up the cleaning web into the take-up spool to smooth out wrinkles on the cleaning web and take up slack in the cleaning web; and re-tension the transport belt.

20. The method of claim 15, further comprising steps of replacing the cleaning web in the rendering system including:

loosen the transport belt;

disengage a wrap roller from the constant velocity capstan drive;

pull a full take-up spool and an empty supply spool out of the rendering system;

install a full supply spool and an empty take-up spool in the rendering system;

use a take-up spool core as a handle extending a full depth of the marking platen to pull the cleaning web from the supply spool between the transport belt and the marking platen by moving the take-up spool core;

move the core and the cleaning web around the constant velocity capstan drive and dock the take-up spool onto its mount;

engage the wrap roller to the constant velocity capstan drive;

manually roll up the cleaning web into the take-up spool to smooth out wrinkles on the cleaning web and take up slack in the cleaning web; and re-tension the transport belt.

* * * * *